United States Patent [19]

Tanaka

[11] Patent Number: 4,928,295

[45] Date of Patent: May 22, 1990

[54] HIGH-VOLTAGE GENERATING DEVICE FOR USE WITH AN X-RAY TUBE

[75] Inventor: Shigeru Tanaka, Ootawara, Japan

[73] Assignee: Kabushiki Kaisha Toshiba, Kawasaki, Japan

[21] Appl. No.: 247,455

[22] Filed: Sep. 21, 1988

[30] Foreign Application Priority Data

Sep. 30, 1987 [JP] Japan ..... 62-243924

[51] Int. Cl.[5] ..... H05G 1/34

[52] U.S. Cl. ..... 378/104; 378/111; 378/112; 378/117

[58] Field of Search ..... 378/104, 111, 112, 117, 378/118

[56] References Cited

U.S. PATENT DOCUMENTS

| | | | |
|---|---|---|---|
| 4,208,584 | 6/1980 | Vogler et al. | 378/117 |
| 4,439,868 | 3/1984 | Makino et al. | 378/112 |
| 4,614,999 | 9/1986 | Onodera et al. | 378/112 |

OTHER PUBLICATIONS

West German Patent Office Action dated Apr. 13, 1989, and an English translation.

*Primary Examiner*—Carolyn E. Fields
*Assistant Examiner*—David P. Porta
*Attorney, Agent, or Firm*—Finnegan, Henderson, Farabow, Garrett and Dunner

[57] ABSTRACT

A high-voltage generating device for use with an X-ray tube comprises a converter circuit for rectifying, chopper controlling, boosting and rectifying an A.C. voltage from an A.C. power supply to apply a D.C. voltage to the X-ray tube, a tube-voltage detecting circuit for detecting a tube voltage of the X-ray tube to produce a signal corresponding to the detected tube voltage, a preset signal generator for generating a signal corresponding to a constant voltage, and a feed-back control circuit for controlling the chopper transistor of the converter circuit on the basis of the output of the preset signal generator at the start of operation and on the basis of the output of the tube voltage detecting circuit after the output of the tube voltage detecting circuit has reached a reference value.

6 Claims, 4 Drawing Sheets

HIGH-VOLTAGE GENERATING DEVICE FOR USE WITH AN X-RAY TUBE

BACKGROUND OF THE INVENTION

1. Field of the Invention

The present invention relates to an X-ray tube high-voltage generating device using a converter circuit for rectifying and boosting an A.C. voltage.

2. Description of the Related Art

A typical prior art high voltage generator for use with an X-ray tube is shown in FIG. 1.

The generator comprises: an A.C. power source 2; a converter circuit 3 connected to receive an A.C. voltage from power source 2 and adapted for successive rectifying, chopper controlling, boosting and rectifying to produce a D.C. high voltage for application to an X-ray tube 4; and a feedback control circuit 15 for monitoring the direct-current high voltage produced by converter circuit 3 so as to control the switching action of converter circuit 3.

More specifically, converter circuit 3 comprises: an input rectifying circuit 6 for rectifying the A.C. voltage from power source 2; a boosting transformer T having a primary winding N1 whose neutral point is coupled to an output terminal (plus) of rectifying circuit 6 through a chopper transistor TR1 and whose both ends are alternately coupled to the other output terminal (minus) of rectifying circuit 6 through inverter transistors TR2 and TR3 and two secondary windings N2 and N3 across which A.C. high voltages are developed; output rectifying circuits *7a* and *7b* for rectifying the A.C. high voltages to provide D.C. high voltages; voltage dividing resistors R1 and R2 connected in series between positive and negative output terminals of rectifying circuit *7a;* voltage dividing resistors R3 and R4 connected in series between positive and negative output terminals of rectifying circuit *7b,* the positive output terminal of rectifying circuit *7b* and the negative output terminal of rectifying circuit *7a* being connected together; a tube-current detecting circuit 8 coupled to the positive output terminal of rectifying circuit *7a,* which is connected to the anode of X-ray tube 4; and a cathode heating circuit 9 connected between the negative output terminal of output rectifying circuit *7b,* which is connected to a terminal of a cathode of X-ray tube 4, and the other terminal of the cathode of X-ray tube 4.

Tube-current detecting circuit 8 is adapted to detect a tube current of X-ray tube 4 and control cathode heating circuit 9 in accordance with the result of the tube-current detection. As a result, the temperature of the cathode of X-ray tube 4 is so controlled that the tube current has a desired value. Broken lines in FIG. 1 denote control signal lines.

Feedback control circuit 15 comprises: a tube-voltage detecting circuit 10 connected to a junction of resistors R1 and R2 and a junction of resistors R3 and R4 and adapted to detect the D.C. high voltage impressed across X-ray tube 4 through detection of a voltage obtained by dividing the D.C. high voltage by means of resistors R1 through R4; and a chopper control circuit 11 adapted to control chopper transistor TR1 in accordance with the tube voltage detected by tube-voltage detecting circuit 10.

In the prior art circuit, chopper control circuit 11 always controls the on-time (duty factor) of a switching pulse applied to chopper transistor TR1 in accordance with the detected tube voltage. As a result, even if the A.C. voltage of power supply 2 varies, the tube voltage will be kept at the desired constant value by means of the feedback control. For this reason, the prior art circuit will suffer disadvantages at the start of operation. That is, when the operation starts, a tube voltage is very small or almost 0 volts. This means that a detected tube voltage and the desired voltage differ significantly. This results in a much increased on-time of the switching pulse produced by chopper control circuit 11. As a result, the voltage and current of chopper transistor TR1 and inverter transistors TR2 and TR3 could be twice as large as the normal voltage and current. Therefore, these transistors must have high ratings in order to avoid overload.

In order to obviate the disadvantages, an attempt has been made to control the chopper transistor by a switching pulse with a fixed pulse width (duty ratio) during a certain time from the start of operation without performing the feedback control and to subsequently perform the above-described feedback control. In this case, however, an output D.C. high voltage can have degraded rising characteristics. For example, it may take a long time for the output D.C. voltage to rise under a high output condition (high voltage and high current), while an overshoot may occur in the output D.C. voltage under a low output condition.

As described above, the problems with the prior art device are that the transistors in the converter circuit may be overloaded, or the rising time of the output D.C. voltage may be prolonged or the overshoot may occur in the output voltage depending on the output conditions.

SUMMARY OF THE INVENTION

It is accordingly an object of the present invention to provide a high-voltage generating device for use with an X-ray tube, which uses a converter circuit adapted to rectify and boost an A.C. voltage and which can avoid the overload of transistors used in the converter circuit, the prolongation of the rise time of an output D.C. voltage and the occurrence of an overshoot in the D.C. voltage.

A high-voltage generating device for use with an X-ray tube according to the present invention comprises a converter circuit for rectifying, chopper controlling, boosting and rectifying an A.C. voltage from an A.C. power supply to apply a D.C. voltage to the X-ray tube, a tube-voltage detecting circuit for detecting a tube voltage of the X-ray tube to produce a signal corresponding to the detected tube voltage, a preset signal generator for generating a signal corresponding to a constant voltage, and a feedback control circuit for controlling the chopper transistor of the converter circuit on the basis of the output of the preset signal generator at the start of operation and on the basis of the output of the tube voltage detecting circuit thereafter.

DETAILED DESCRIPTION OF THE PREFERRED EMBODIMENTS

Figure 1:
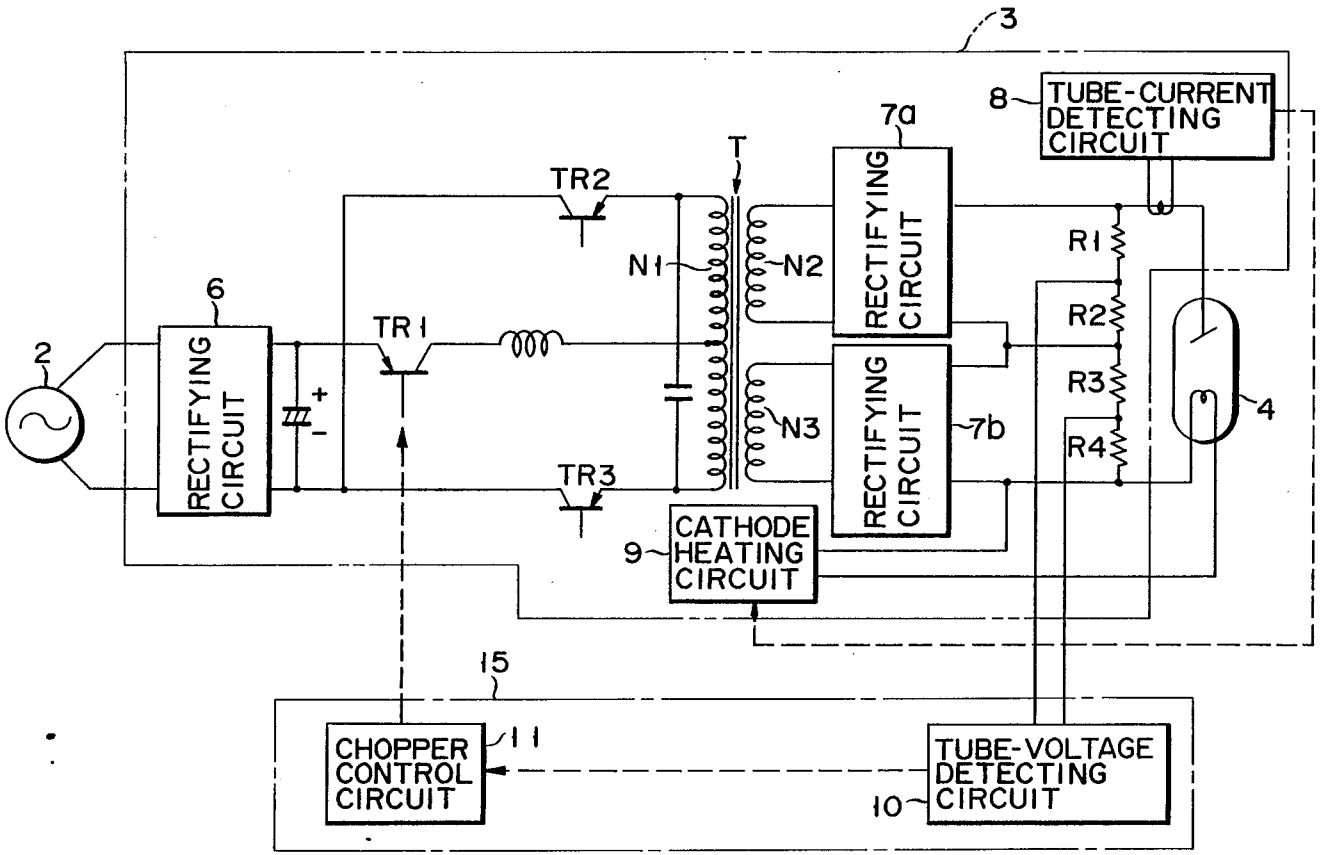
FIG. 1 (PRIOR ART)
FIG. 1 shows a circuit arrangement of a prior-art high-voltage generating device for use with an X-ray tube.
Figure 2:
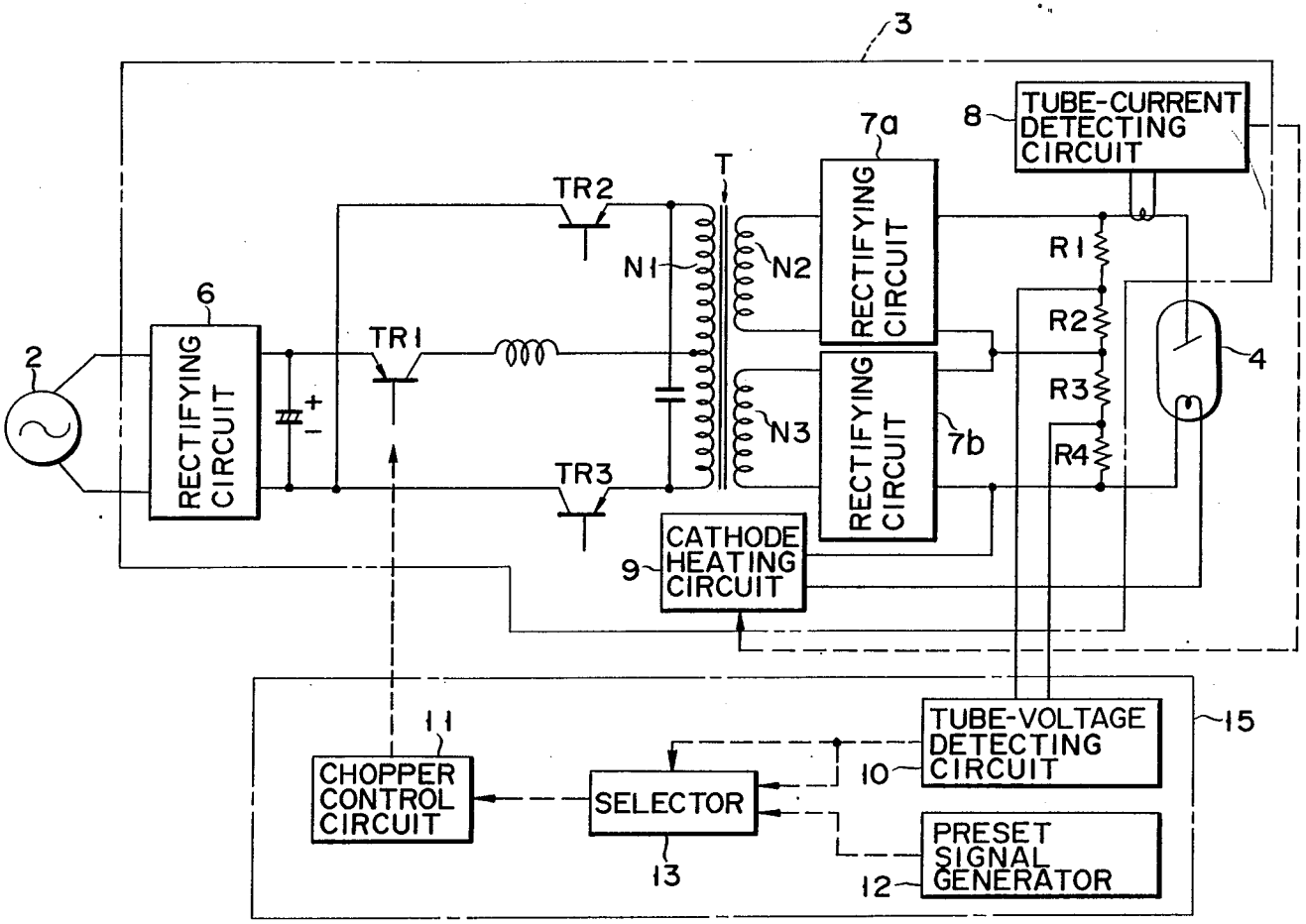
FIG. 2 shows a circuit arrangement of a high-voltage generating device embodying the present invention.

An embodiment of a high-voltage generating device for use with an X-ray tube according to the present invention will be described with reference to FIG. 2. In FIG. 2, same reference numerals are used to denote corresponding parts in FIG. 1.

The embodiment includes: a converter circuit 3 connected between an A.C. power supply 2 and an X-ray tube 4 and adapted to rectify an A.C. voltage from A.C. power supply 2 and subsequently perform rectifying, chopper controlling, boosting and rectifying in succession so as to generate a D.C. high voltage for application to X-ray tube 4; and a feedback control circuit 15 adapted to monitor the D.C. high voltage generated by converter circuit 3 so as to control the chopper action of converter circuit 3. The converter circuit is the same as that shown in FIG. 1.

The present invention is featured by feedback control circuit 15, which comprises a tube-voltage detecting circuit 10 connected to the junction of resistors R1 and R2 and the junction of resistors R3 and R4 for providing a signal corresponding to a voltage resulting from the division of a D.C. high voltage impressed across X-ray tube 4 by means of resistors R1 through R4; a preset signal generator 12 for generating a control signal corresponding to a preset voltage; a selector 13 responsive to an output value of tube-voltage detecting circuit 10 for selectively outputting either one of an output of tube-voltage detecting circuit 10 and an output of preset signal generator 12; and a chopper control circuit 11 for applying a switching pulse, whose pulse width (duty factor) depends on the value of an output signal of selector 13, to a chopper transistor TR1 for chopper control thereof.

Figure 3:
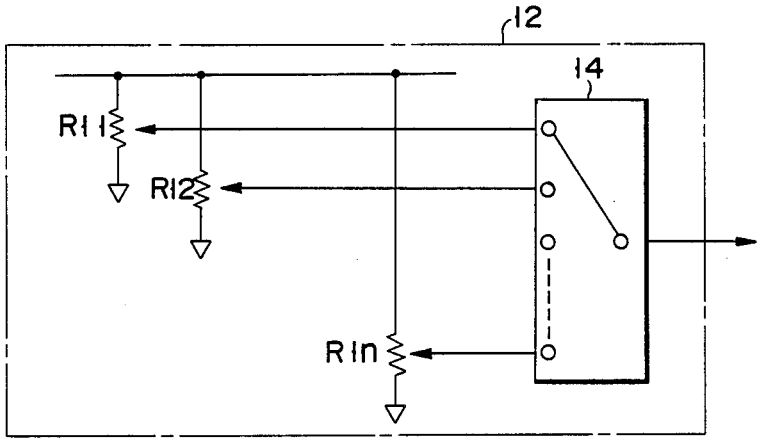
FIG. 3 shows an arrangement of a preset signal generator.

As shown in FIG. 3, preset signal generator 12 is comprised of a plurality of variable resistors (potentiometers) R11 through R1n adapted for generating different analog voltages, and an analog switch 14 for selecting one of the variable resistors to take out a corresponding analog voltage.

The magnitudes of the analog voltages provided by variable resistors R11~R1n are determined such that, when chopper control circuit 11 controls chopper transistor TR1 on the basis of an analog voltage from the variable resistors, chopper transistor TR1 and inverter transistors TR2 and TR3 are not overloaded, namely, the voltage and current do not exceed ratings of the transistors, and the converter output voltage stably rises without the prolongation of its rise time and the occurrence of the overshoot.

In operation, analog switch 14 is first switched to select an optimum one of variable resistors in accordance with the output condition When power supply 2 is turned on, an A.C. voltage is fed to converter circuit 3 to provide a D.C. high voltage to X-ray tube 4 so that X rays are emitted from X-ray tube 4.

Figure 4:
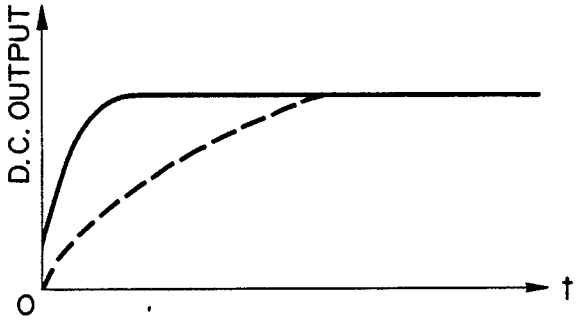
FIGS. 4 and 5 are diagrams showing characteristics of the embodiment.
Figure 5:
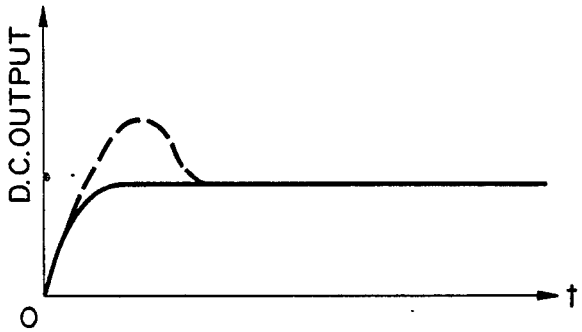

At the start of operation, the output voltage of tube-voltage detecting circuit 10 is low with the result that selector 13 selects an output of preset signal generator 12 and feeds it to chopper control circuit 11. Consequently, chopper transistor TR1 performs a chopper operation based on a fixed pulse width (duty factor), preventing the loads of chopper transistor TR1 and inverter transistors TR2 and TR3 from overloading. Moreover, since the preset signal value is selected according to the output condition, the D.C. high voltage impressed to X-ray tube 4 from rectifying circuits 7*a* and 7*b* will not have such a degradation of the rising characteristics as shown by a broken line in FIG. 4 and such an overshoot as shown by a broken line in FIG. 5. The solid lines of FIGS. 4 and 5 show the characteristics of the embodiment.

The output D.C. high voltage rises gradually. When it reaches a predetermined value near a rated voltage (the tube voltage), for example, about 70% of the rated voltage, selector 13 is switched to select the output of tube-voltage detecting circuit 10. As a result, converter circuit 3 is enabled to perform the feedback control. Thus, chopper transistor TR1 performs the chopper control based on the pulse width (duty factor) which can vary with the tube voltage (output voltage of converter circuit 3).

According to this embodiment, as described above, the chopper control based on the constant pulse width is performed at the start of operation, the variable-pulse-switching control (feedback control) is performed on the basis of the output of the tube-voltage detector after the output of the converter circuit has reached a reference value. For this reason, the overloading the transistors in the converter circuit, the degradation of the rise time and the occurrence of the overshoot can be prevented. Further, since the tube voltage rises quickly, data acquisition can be started immediately, an irradiation time of X rays can be reduced, and unnecessary power consumption can be avoided.

Figure 6:
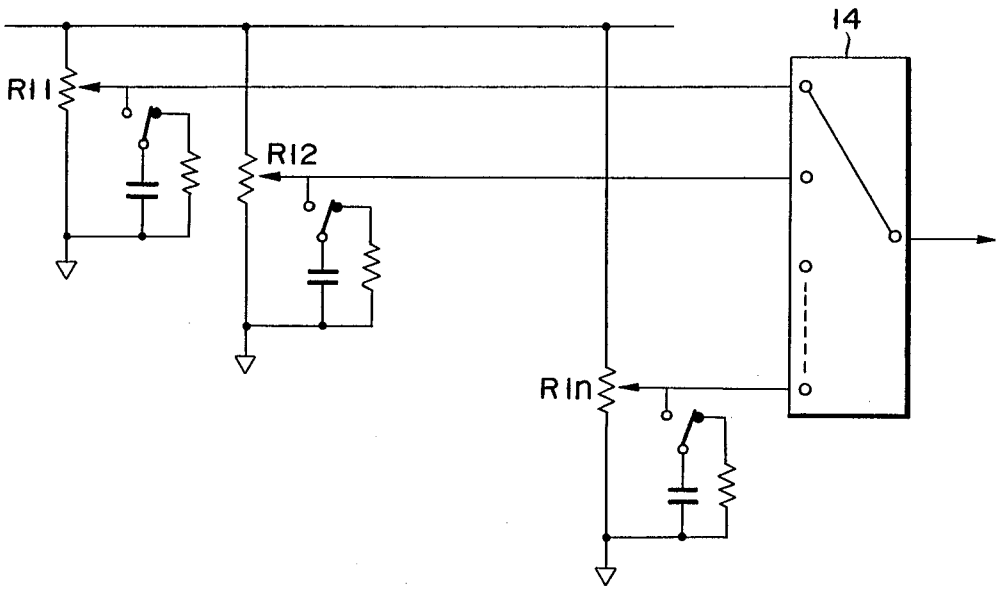
FIG. 6 shows another arrangement of the preset signal generator.

The present invention is not limited to the above embodiment. For example, the switching of control from the switching control based on the constant pulse width to the switching control based on the feedback-controlled variable pulse width may be performed by the use of a timer instead of using the result of detection of the tube voltage as in the embodiment. Further, preset signal generator 12 may be equipped with soft-start circuits each formed of a capacitor and a resistor as shown in FIG. 6. Alternatively, the preset signal generator may be comprised of a memory for storing preset data and a digital-to-analog converter.

What is claimed is:

1. A high-voltage generating device for use with an X-ray tube, comprising:

first rectifying means, having first and second output terminals, for rectifying an A.C. voltage from an A.C. power supply;

a converter for converting an output of said first rectifying means to an A.C. voltage and boosting the converted A.C. voltage, the converter including a boosting transformer having a primary winding having a neutral point and first and second ends, the neutral point of said primary winding being connected to said first output terminal of said first rectifying means through a chopper transistor, and each of said first and second ends of said primary winding being connected to said second output terminal of said first rectifying means through a first inverter transistor and a second inverter transistor, said first and second inverter transistors being alternately operated, said converter further including a second winding for providing an A.C. high voltage, each of said chopper transistor and said first and second inverter transistors having a predetermined voltage rating;

second rectifying means for converting an output of said converter to a D.C. voltage for application to said X-ray tube;

detecting means for detecting an output voltage of said second rectifying means to produce a signal corresponding to the detected voltage;

preset signal generating means for generating a signal having a constant voltage lower than the voltage ratings of said chopper transistor and said first and second inverter transistors; and feedback control means for controlling a switching operation of said converter on the basis of an output of said preset signal generating means at the start of operation and on the basis of an output of said detecting means thereafter.

2. The device according to claim 1, wherein said feedback control means comprises a selector connected to outputs of said detecting means and said preset signal generating means and responsive to an output of said detecting means for selecting and outputting an output of said preset signal generating means when the output of said detecting means is below a reference value and an output of said detecting means after the output of said detecting means has reached the reference value; and a chopper control circuit for producing a switching pulse whose duty factor is determined on the basis of an output of said selector.

3. The device according to claim 2, wherein the output of said preset signal generating means is determined such that, when a switching pulse based on the output of said preset signal generating means is applied to said chopper transistor, said chopper transistor and said inverter transistors are not overloaded, and the converter output stably rises without the prolongation of its rise time and the occurrence of an overshoot.

4. The device according to claim 1, wherein said feedback control means controls the operation of said converter on the basis of the output of said detecting means after a lapse of a certain time from the start of operation.

5. The device according to claim 1, wherein said preset signal generating means comprises a plurality of potentiometers for generating signals corresponding to different voltages; and an analog switch for selecting one of said potentiometers.

6. The device according to claim 1, wherein said preset signal generating means comprises a digital memory for storing data corresponding to different voltages and outputting a piece of data; and a converter for converting the piece of data output from said memory to a corresponding analog voltage.

* * * * *